US006887129B2

(12) United States Patent
Birang et al.

(10) Patent No.: US 6,887,129 B2
(45) Date of Patent: May 3, 2005

(54) CHEMICAL MECHANICAL POLISHING WITH FRICTION-BASED CONTROL

(75) Inventors: Manoocher Birang, Los Gatos, CA (US); Shijian Li, San Jose, CA (US)

(73) Assignee: Applied Materials, Inc., Santa Clara, CA (US)

( * ) Notice: Subject to any disclaimer, the term of this patent is extended or adjusted under 35 U.S.C. 154(b) by 11 days.

(21) Appl. No.: 10/666,891

(22) Filed: Sep. 17, 2003

(65) Prior Publication Data

US 2004/0072500 A1 Apr. 15, 2004

Related U.S. Application Data

(62) Division of application No. 09/562,801, filed on May 2, 2000, now Pat. No. 6,623,334.

(60) Provisional application No. 60/132,668, filed on May 5, 1999.

(51) Int. Cl.[7] ..... B24B 49/16

(52) U.S. Cl. ..... 451/10; 451/5

(58) Field of Search ..... 451/10, 41, 288, 451/287, 5, 8

(56) References Cited

U.S. PATENT DOCUMENTS

| | | | |
|---|---|---|---|
| 5,069,002 | A | 12/1991 | Sandhu et al. |
| 5,486,129 | A | 1/1996 | Sandhu et al. |
| 5,597,341 | A | 1/1997 | Kodera et al. |
| 5,639,388 | A | 6/1997 | Kimura et al. |
| 5,647,952 | A | 7/1997 | Chen |
| 5,700,180 | A | 12/1997 | Sandhu et al. |
| 5,720,845 | A | 2/1998 | Liu |
| 5,733,176 | A | 3/1998 | Robinson et al. |
| 5,738,562 | A | 4/1998 | Doan et al. |
| 5,743,784 | A | 4/1998 | Birang et al. |
| 5,830,041 | A | 11/1998 | Takahashi et al. |
| 5,846,882 | A | 12/1998 | Birang |
| 5,851,135 | A | 12/1998 | Sandhu et al. |
| 5,860,847 | A | 1/1999 | Sakurai et al. |
| 5,914,275 | A | 6/1999 | Kodera et al. |
| 5,948,205 | A | 9/1999 | Kodera et al. |
| 6,046,111 | A | 4/2000 | Robinson |
| 6,120,347 | A | 9/2000 | Sandhu et al. |
| 6,191,037 | B1 | 2/2001 | Robinson et al. |
| 6,206,754 | B1 | 3/2001 | Moore |
| 6,238,590 | B1 | 5/2001 | Fischer et al. |
| 6,257,953 | B1 | 7/2001 | Gitis et al. |
| 6,283,829 | B1 | 9/2001 | Molnar |
| 6,340,434 | B1 | 1/2002 | Mizuno et al. |
| 6,623,334 | B1 | 9/2003 | Birang et al. |

FOREIGN PATENT DOCUMENTS

| | | | |
|---|---|---|---|
| EP | 0 771 611 | A | 5/1997 |

*Primary Examiner*—Robert A. Rose
(74) *Attorney, Agent, or Firm*—Fish & Richardson

(57) ABSTRACT

A chemical mechanical polishing apparatus has a polishing surface, a carrier head to press a substrate against the polishing surface with a controllable pressure, a motor to generate relative motion between the polishing surface and the carrier head at a velocity, and a controller. The controller is configured to vary at least one of the pressure and velocity in response to a signal that depends on the friction between the substrate and the polishing surface to maintain a constant torque, frictional force, or coefficient of friction.

24 Claims, 3 Drawing Sheets

CHEMICAL MECHANICAL POLISHING WITH FRICTION-BASED CONTROL

CROSS-REFERENCE TO RELATED APPLICATIONS

This application is a divisional application (and claims the benefit of priority under 35 USC 120) of U.S. application Ser. No. 09/562,801, filed on May 2, 2000 now U.S. Pat. No. 6,623,334, which claims priority to U.S. Provisional Application Serial No. 60/132,668, filed May 5, 1999. The disclosures of the prior applications are considered part of (and are incorporated by reference in) the disclosure of this application.

BACKGROUND

The present invention relates generally to chemical mechanical polishing of substrates, and more particularly to a method of and apparatus for controlling a chemical mechanical polisher.

Integrated circuits are typically formed on substrates, particularly silicon wafers, by the sequential deposition of conductive, semiconductive or insulative layers. After each layer is deposited, it is etched to create circuitry features. As a series of layers are sequentially deposited and etched, the outer or uppermost surface of the substrate, i.e., the exposed surface of the substrate, becomes increasingly nonplanar. This nonplanar surface can present problems in the photolithographic steps of the integrated circuit fabrication process. Therefore, there is a need to periodically planarize the substrate surface. In addition, plaranization is needed when polishing back a filler layer, e.g., when filling trenches in a dielectric layer with metal.

Chemical mechanical polishing (CMP) is one accepted method of planarization. This planarization method typically requires that the substrate be mounted on a carrier or polishing head. The exposed surface of the substrate is placed against a rotating polishing pad. The polishing pad may be either a "standard" or a fixed-abrasive pad. A standard polishing pad has a durable roughened or soft surface, whereas a fixed-abrasive pad has abrasive particles held in a containment media. The carrier head provides a controllable load, i.e., pressure, on the substrate to push it against the polishing pad. Some carrier heads include a flexible membrane that provides a mounting surface for the substrate, and a retaining ring to hold the substrate beneath the mounting surface. Pressurization or evacuation of a chamber behind the flexible membrane controls the load on the substrate. A polishing slurry, including at least one chemically-active agent, and abrasive particles if a standard pad is used, is supplied to the surface of the polishing pad.

The effectiveness of a CMP process may be measured by its polishing rate, and by the resulting finish (absence of small-scale roughness) and flatness (absence of large-scale topography) of the substrate surface. The polishing rate, finish and flatness are determined by the pad and slurry combination, the relative speed between the substrate and pad, and the force pressing the substrate against the pad.

One reoccurring problem in CMP is instability in the polishing rate. In some polishing operations, the polishing rate tends to drift over time. As a result, it becomes more difficult to control endpointing and to polish each substrate by the same amount. This tends to result in dishing and erosion during metal polishing. Other reoccurring problems in CMP include temperature drift and system vibrations.

SUMMARY

In one aspect, the invention is directed to a chemical mechanical polishing apparatus. The apparatus has a polishing surface, a carrier head to press a substrate against the polishing surface with a controllable pressure, a motor to generate relative motion between the polishing surface and the carrier head at a velocity, and a controller configured to vary at least one of the pressure and velocity in response to a signal that depends on the friction between the substrate and the polishing surface to maintain a constant torque, frictional force, or coefficient of friction.

Implementations of the invention may include one or more of the following features. The controller may be configured to vary the pressure to maintain a constant torque, to vary the pressure to maintain a constant friction, to vary the pressure to maintain a constant frictional coefficient, to vary the velocity to maintain a constant torque, to vary the velocity to maintain a constant friction, to vary the velocity to maintain a constant frictional coefficient, to vary the velocity and the pressure to maintain a constant torque, to vary the velocity and the pressure to maintain a constant friction, or to vary the velocity and the pressure to maintain a constant frictional coefficient.

In another aspect, the invention is directed to a chemical mechanical polishing apparatus that has a polishing surface, a carrier head to press a substrate against the polishing surface with a controllable pressure, and a pressure controller to control the pressure applied by the carrier head in response to a friction between the substrate and the polishing surface to maintain a substantially constant polishing rate.

Implementations of the invention may include one or more of the following features. The polishing surface may include a fixed abrasive polishing material. A motor may create relative motion between the polishing surface and the substrate. The pressure controller may comprise a digital computer configured to receive a motor signal representing a current in the motor to create relative motion between the polishing surface and the substrate, and to derive a carrier head pressure control signal by subtracting a threshold value from the motor signal. The digital computer may be configured to amplify or attenuate the difference between the threshold and the motor signal to determine the carrier head pressure control signal. The digital computer may be configured to smooth the carrier head pressure control signal. The motor signal may be a carrier head control signal, a platen control signal, or a motor current signal. The polishing surface may be placed on a rotatable platen and the motor may rotate the platen. The motor may rotate the carrier head.

In another aspect, the invention is directed to a method of chemical mechanical polishing. In the method, a substrate is pressed against a polishing surface with a controllable pressure, relative motion is caused between the polishing surface and the substrate at a velocity, and at least one of the pressure and velocity is controlled in response to a signal that depends on the friction between the substrate and the polishing surface to maintain a constant torque, frictional force, or coefficient of friction.

Potential advantages of the invention include zero or more of the following. A uniform frictional force may be maintained between the substrate and the polishing pad, thereby reducing fluctuations in the polishing rate. A uniform frictional force may be maintained despite variations in the pattern density on the substrate, physical properties of the polishing pad, polishing pad degradation, and changes in temperature at the pad-substrate interface. In addition, by improving the uniformity of friction, vibrations in the polishing machine and drift of the substrate temperature may be reduced. Moreover, dishing and erosion in the substrate can be reduced.

Other features, objects, and advantages of the invention will be apparent from the following description, which includes the drawings and claims.

BRIEF DESCRIPTION OF DRAWINGS

Like reference symbols in the various drawings indicate like elements.

DETAILED DESCRIPTION

It is desirable to maintain a constant polishing rate during chemical mechanical polishing to ensure process uniformity. The invention improves the stability of the polishing rate, e.g., for fixed-abrasive polishing pads, by adjusting the pressure applied to the substrate by the carrier head to ensure a constant friction force between the substrate and the polishing pad. A substantially constant frictional force may be maintained despite variations in the pattern density on the substrate, physical properties of the polishing pad, polishing pad degradation, and changes in temperature at the pad-substrate interface. A constant polishing rate helps reduce dishing and erosion during metal polishing. In addition, by improving the stability of the frictional force, vibrations of the polishing machine can be dampened and temperature drift can be reduced.

In brief, the controller (which could be implemented in hardware or software) for the polishing apparatus can receive a signal indicative of the frictional force between the substrate and polishing pad. Examples of such signals include torque measurements, frictional force measurements, and frictional coefficient measurements. These measurements may be made on the platen or the carrier head. The controller includes a feedback mechanism that uses the signal to control the carrier head pressure and maintain a relatively constant frictional force. For example, a control signal to a platen or carrier head drive motor can be compared to a threshold signal, and the difference can be amplified or attenuated to adjust the carrier head pressure.

Figure 1:
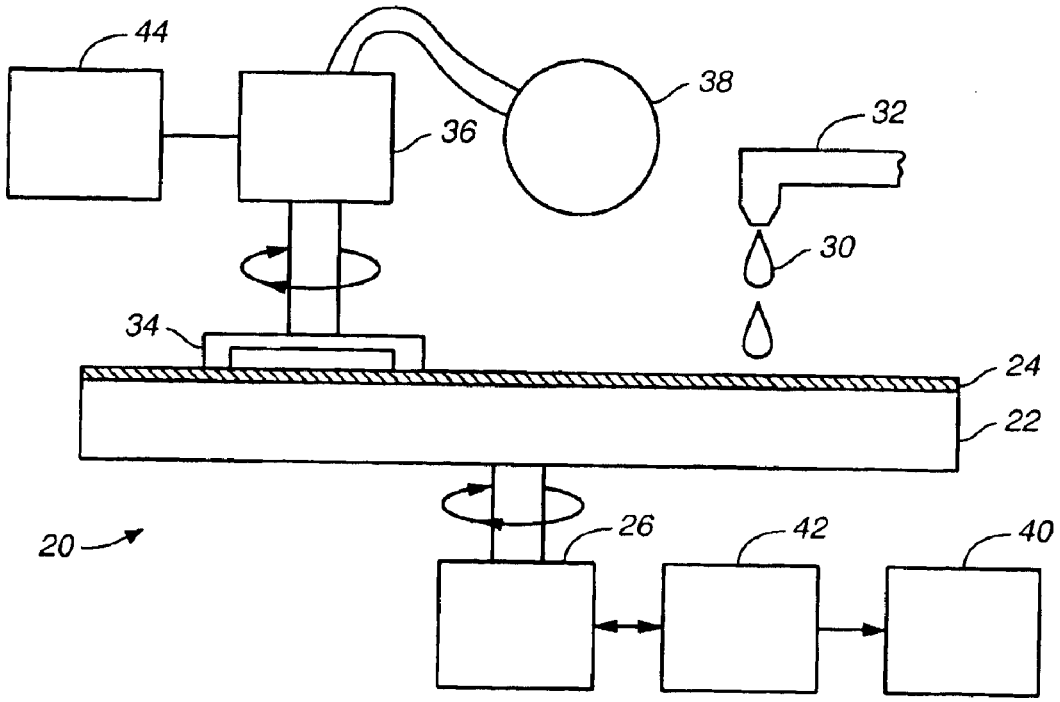
FIG. 1 is a cross-sectional view of a polishing apparatus constructed according to the present invention.

FIG. 1 shows a chemical mechanical polishing (CMP) apparatus 20 that includes a rotatable platen 22. A polishing pad 24, such as a fixed-abrasive pad with abrasive particles embedded in a containment media, is attached to the upper surface of platen 22. The platen is driven by a platen drive motor 26, e.g., at thirty to two-hundred revolutions per minute, although lower or higher rotational speeds may be used. A polishing liquid 30, which need not contain abrasive particles if a fixed-abrasive polishing pad is used, is supplied to the surface of polishing pad 24, e.g., by a combined slurry supply/rinse arm 32.

A carrier head 34 holds a substrate 10 and presses it against polishing pad 24 with a controllable load. The carrier head 34 can include a flexible membrane or a rigid carrier that provides a mounting surface for the substrate, and a pressurizable chamber to control the downward force on the substrate. Alternately, the entire carrier head can be moved vertically by a pneumatic actuator to control the pressure on the substrate. Carrier head 34 is rotated about its own axis by a carrier head drive motor 36, and oscillates laterally across the polishing pad. A variable pressure source 38 can be fluidly connected to carrier head 34, e.g., by an unillustrated rotary union, to maintain the carrier head at a desired pressure. An exemplary carrier head is described in U.S. patent application Ser. No. 09/470,820, filed Dec. 23, 1999, the entirety of which is incorporated herein by reference.

The CMP apparatus 20 can also include an unillustrated pad conditioner or cleaner to maintain the abrasive condition of the polishing pad. A description of a CMP apparatus that includes multiple platens and multiple carrier heads can be found in U.S. Pat. No. 5,738,574, the entire disclosure of which is hereby incorporated by reference.

Platen drive motor 26 is controlled by a platen drive controller 42 that uses a feedback control loop to sense the torque and/or rotation rate of the platen (e.g., with an optical encoder) and generate a signal representing the power or current needed by the platen drive motor to maintain the platen at a selected rotation rate. Similarly, carrier head drive motor 34 can be controlled by a carrier head drive controller 44 that uses a feedback control loop to sense the rotation rate and/or torque of the carrier head and generate a signal representing the power or current needed by the carrier head drive motor to maintain the carrier head at a constant rotation rate.

In general, the polishing rate depends, in principle, on the frictional force applied to the substrate by the polishing pad. This frictional force is proportional to the coefficient of friction (sometime referred to as the surface friction) between the polishing pad and the substrate, the load of the substrate against the polishing pad, and the relative velocity between the substrate and polishing pad, and the torque on the platen is proportional to the frictional force and the radial position of the substrate.

One problem that may be encountered in chemical mechanical polishing is difficulty with process stability, particularly polishing rate stability. In some polishing processes, the polishing rate will change over time even if the polishing pressure is held uniform. These variations can occur from substrate to substrate, or even during polishing of a single substrate. For example, some polishing pads have a "break-in" period during which the surface friction of the pad varies. Specifically, the frictional coefficient (and polishing rate) of a polishing pad tends to increase as polishing progresses during the break-in period, until it reaches a "static state" with a constant polishing rate at the end of the break-in period. If the substrate is flat and smooth, the surface friction of the polishing pad changes very slowly. For example, about 100 minutes of polishing are required to reach a steady-state polishing rate for copper polishing with a fixed-abrasive polishing pad and a constant pressure on the substrate. Another problem that may be encountered in CMP is that fluctuations in processes conditions, such as the temperature or supply of slurry on the pad, result in changes in the friction between the polishing pad and substrate, and thus changes in the polishing rate. Process stability is particularly hard to control in fixed-abrasive polishing.

To compensate for these effects, the pressure applied to substrate 10 by carrier head 34 is controlled to maintain a substantially constant frictional force between the substrate and the polishing pad, and thus a substantially constant polishing rate. In contrast to conventional CMP processes in which substrate pressure and velocity are held substantially constant, in CMP apparatus 20 the substrate pressure and/or velocity are adjusted to maintain a substantially constant friction, torque or friction coefficient between the substrate and polishing pad. The pressure source 38 is coupled to a pressure controller 40, e.g., a digital computer programmed with a process control loop, that selects and adjusts the pressure to create a constant polishing rate. In one implementation, pressure controller 40 receives a control signal associated with one of the drive motors, e.g., platen drive motor 26. As previously noted, this control signal represents the power or current required for the platen drive motor to rotate the platen at a preselected rotation rate. Since the power needed to maintain the drive motor at a constant rotation rate increases if the substrate exerts an increased frictional drag on the platen, the control signal should be proportional to the torque on the platen.

Figure 2:
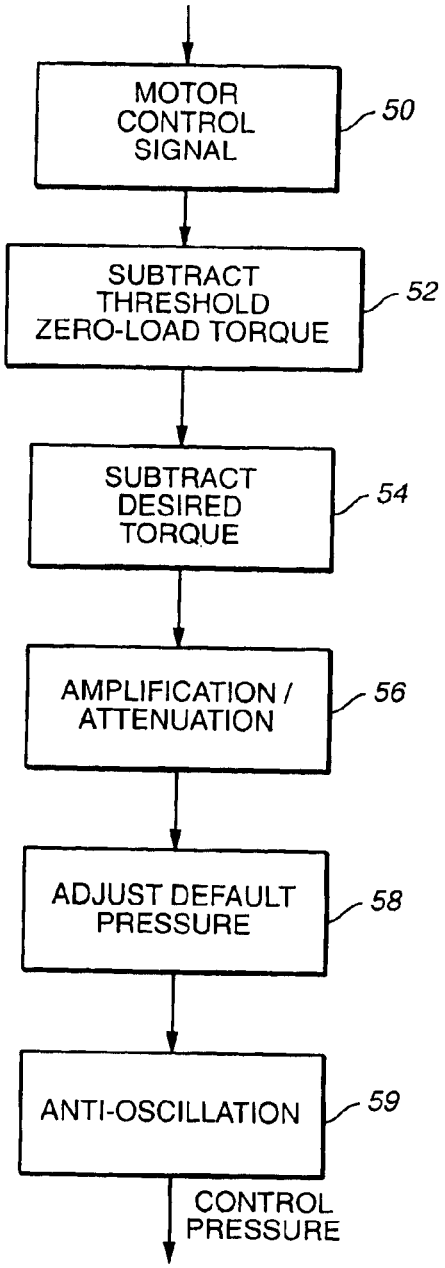
FIG. 2 is a flow chart illustrating a method performed by a torque-based control system to control the carrier head in the polishing apparatus of FIG. 1.

Referring to FIG. 2, pressure controller 40 performs a torque-based process control loop to determine the proper pressure for the carrier head. The pressure controller 40 stores a first threshold (or "load-free torque") that represents the torque on the platen when no pressure is being applied to the substrate. Thus, torque below the first threshold results from physical drag on the platen from bearings and the like. The first threshold can be determined experimentally. The pressure controller 40 also stores a second threshold that represents a torque desired by the user during polishing. The second threshold can be set by the user (e.g., with a software user interface).

FIG. 2 shows the steps performed in one pass through the control loop. First, the pressure control receives the signal associated with the torque, e.g., the motor control signal (step 50). The first stored threshold is subtracted from the control signal (step 52) to create a second signal that is proportional to the amount of torque caused by the pressure of the substrate on the polishing pad. Then the second stored threshold is subtracted from the second signal (step 54) to generate a differential signal. The resulting differential signal is amplified or attenuated (step 56), depending on the magnitude of the feedback on the carrier head and how much the carrier head pressure should be adjusted. The controller then calculates a carrier head pressure to provide the desired torque (step 58). For example, the amplified or attenuated differential signal can be subtracted from (assuming that the control signal exceeds the threshold signal) or added to (assuming that the control signal is less than the threshold signal) a default pressure to generate a carrier head pressure signal. Finally, the carrier head pressure signal may be smoothed to prevent oscillation (step 59).

If the coefficient of friction of the polishing pad increases, the motor current required to maintain the platen at a constant rotation rate will increase, and the control signal will exceed the second threshold. Consequently, the carrier head pressure will decrease below the default pressure so that the friction between the substrate and polishing pad, and thus the polishing rate, is maintained substantially constant. Similarly, if the coefficient of friction of the polishing pad decreases, the motor current required to maintain the platen at a constant rotation rate will decrease, and the control signal will fall below the second threshold. Consequently, the carrier head pressure will increase above the default pressure so that the effective friction between the substrate and polishing pad, and thus the polishing rate, is maintained substantially constant.

Figure 3:
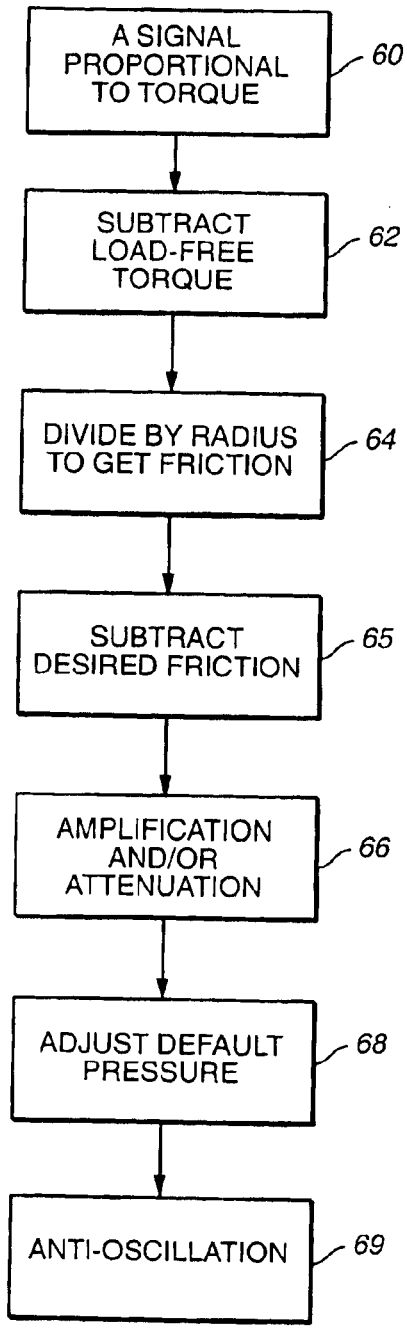
FIG. 3 is a flow chart illustrating a method performed by a frictional force-based control system.

Referring to FIG. 3, in another implementation, pressure controller 40 performs a friction-based process control loop to determine the proper pressure for the carrier head. In this implementation, the controller stores a second threshold that represents a friction desired by the user. First, the pressure control receives the torque signal (step 60) and subtracts the "load-free" torque (step 62) to create a second signal that represents torque caused by the pad-substrate interaction. The second signal is divided by the radial position of the substrate on the platen to generate a signal proportional to the friction between the substrate and polishing pad (step 64). The second threshold is subtracted from the resulting friction signal (step 65) to create a differential signal. The differential signal is amplified or attenuated (step 66), depending on how much the carrier head pressure should be adjusted. The carrier head pressure is then adjusted based to provide the desired friction (step 68). For example, the amplified or attenuated differential signal cab be subtracted from (assuming that the control signal exceeds the threshold signal) or added to (assuming that the control signal is less than the threshold signal) a default pressure to generate a carrier head pressure signal. Finally, the carrier head pressure signal may be smoothed to prevent oscillation (step 69).

Figure 4:
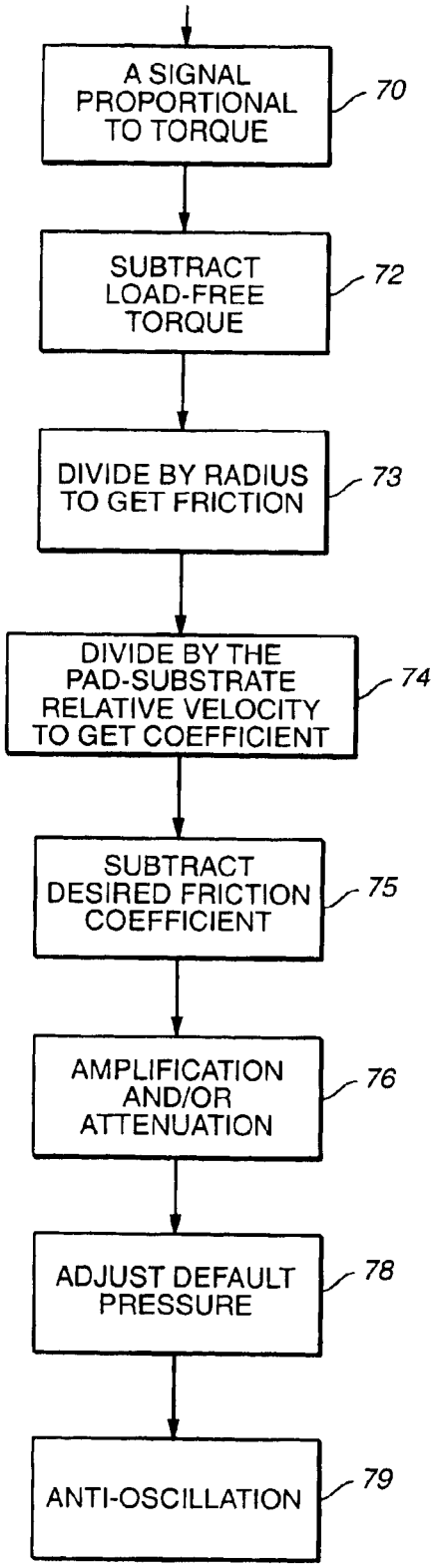
FIG. 4 is a flow chart illustrating a method performed by a frictional coefficient-based control system.

Referring to FIG. 4, in another implementation, pressure controller 40 performs a friction coefficient-based process control loop to determine the proper pressure for the carrier head. In this embodiment, the controller stores a second threshold that represents a frictional coefficient desired by the user. First, the pressure control receives the torque signal (step 70) and subtracts the "torque-free load" (step 72) to create a second signal. The second signal is divided by the radial position of the substrate on the platen to generate a third signal proportional to the friction between the substrate and polishing pad (step 74), and the third signal is divided by the relative velocity between the pad and substrate to generate a fourth signal proportional to the coefficient of friction (step 75). The second threshold is subtracted from the resulting fourth frictional coefficient signal (step 76) to create a differential signal. The differential signal is amplified or attenuated (step 77), depending on how much the carrier head pressure should be adjusted. The carrier head pressure is then adjusted based to provide the desired friction (step 78). For example, the amplified or attenuated differential signal cab be subtracted from (assuming that the control signal exceeds the threshold signal) or added to (assuming that the control signal is less than the threshold signal) a default pressure to generate a carrier head pressure signal. Finally, the carrier head pressure signal may be smoothed to prevent oscillation (step 79).

Figure 5:
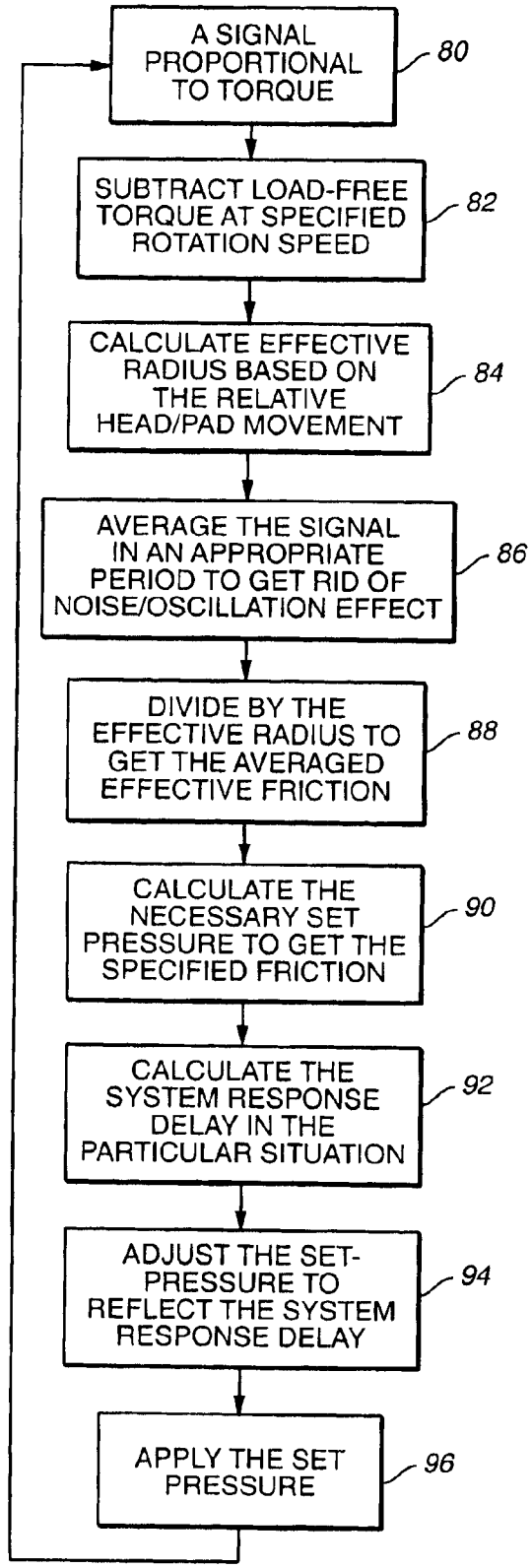
FIG. 5 is a flow chart illustrating a method performed by a software control system.

Referring to FIG. 5, in another implementation, pressure controller 40 performs a more complex friction-based process control loop. In this implementation, the pressure control receives the signal that is proportional to the torque (step 80), and subtracts the "loadfree" torque measurement (step 82) to generate a second signal. The controller calculates the effective radial position of the carrier head on the platen from the carrier head sweep profile (step 84). The second signal is averaged or integrated over a predetermined time period to reduce noise (step 86), and the reduced-noise signal is divided by the effective radial position of the carrier head to determine the average effective friction (step 88). The pressure from the carrier head needed to achieve the desired effective friction is calculated (step 90). A system response delay is calculated (step 92), the pressure is adjusted to reflect the system response delay (step 94), and the adjusted pressure is applied to the substrate (step 96).

Each of the methods shown in FIGS. 2–5 can be carrier out by hardware, software, or a combination of hardware and software. Many of the steps can be performed in another order. For example, the smoothing and averaging of the signal may be performed at any time after the torque signal has been received. Division by the relative velocity may occur before division by the radial position of the substrate. Various calculation steps could be combined into a single calculation.

The advantages of the invention may include the following. First, the initial slow polishing period (the pad break-in period for a fixed-abrasive pad) may be greatly reduced. Second, process stability may be enhanced. Third, the frictional force between the substrate and polishing surface may be held constant, thereby providing a uniform polishing rate for substrates having different patterns. Fourth, the constant frictional force may reduce oscillations and vibrations of the machine parts of the CMP apparatus, and may reduce temperature drift. Fifth, dishing and erosion may be reduced.

Although the Figures illustrate the use of a signal from platen drive controller 42, the signal from carrier head drive controller 44 could be used instead. Alternately, the current flowing to the motor (a motor current signal) can be measured and sent to pressure controller 40. In addition, although the invention has been described for a CMP apparatus that uses a rotating platen and a rotating carrier head, the invention is adaptable to other polishing machines, such as linear belt polishers.

Rather than adjusting the pressure from the carrier head, the rotational rate of the carrier head and/or platen can be adjusted to increase the relative speed between the substrate and polishing pad and thus maintain a relatively constant frictional force. For example, a motor that automatically adjusts to generate a desired torque might be used. In this case, the controller would merely send the desired torque signal to the motor. The remaining control functions to maintain the constant torque would be integrated into the motor itself.

The present invention has been described in terms of a number of embodiments. The invention, however, is not limited to the embodiments depicted and described. Rather, the scope of the invention is defined by the appended claims.

What is claimed is:

1. A method of chemical mechanical polishing, comprising:

pressing a substrate against a polishing surface with a controllable pressure;

creating relative motion between the polishing surface and the substrate at a velocity; and controlling at least one of the pressure and velocity in response to a signal that depends on the friction between the substrate and the polishing surface to maintain a constant torque, frictional force, or coefficient of friction.

2. The method of claim 1, wherein the controlling step includes varying the pressure to maintain a constant torque.

3. The method of claim 1, wherein the controlling step includes varying the pressure to maintain a constant friction.

4. The method of claim 1, wherein the controlling step includes varying the pressure to maintain a constant frictional coefficient.

5. The method of claim 1, wherein the controlling step includes varying the velocity to maintain a constant torque.

6. The method of claim 1, wherein the controlling step includes varying the velocity to maintain a constant friction.

7. The method of claim 1, wherein the controlling step includes varying the velocity to maintain a constant frictional coefficient.

8. The method of claim 1, wherein the controlling step includes varying the velocity and the pressure to maintain a constant torque.

9. The method of claim 1, wherein the controlling step includes varying the velocity and the pressure to maintain a constant friction.

10. The method of claim 1, wherein the controlling step includes varying the velocity and the pressure to maintain a constant frictional coefficient.

11. The method of claim 1, wherein the controlling step includes generating a motor signal representing a current in a motor that creates the relative motion between the polishing surface and the substrate, and deriving a carrier head pressure control signal by subtracting a threshold value from the motor signal.

12. The method of claim 11, wherein the controlling step includes amplifying or attenuating a difference between the threshold and the motor signal to determine the carrier head pressure control signal.

13. The method of claim 11, wherein the motor signal is a carrier head control signal, a platen control signal, or a motor current signal.

14. The method of claim 1, wherein the polishing surface includes a fixed abrasive polishing material.

15. The method of claim 1, wherein creating relative motion includes rotating the polishing surface.

16. The method of claim 1, wherein creating relative motion includes rotating the substrate.

17. A method of chemical mechanical polishing, comprising:

pressing a substrate against a polishing surface with a controllable pressure applied by a carrier head;

creating relative motion between the polishing surface and the substrate at a velocity; and controlling the pressure applied by the carrier head in response to a friction between the substrate and the polishing surface to maintain a substantially constant polishing rate.

18. The method of claim 17, wherein the controlling step includes generating a motor signal representing a current in a motor that creates the relative motion between the polishing surface and the substrate, and deriving a carrier head pressure control signal by subtracting a threshold value from the motor signal.

19. The method of claim 18, wherein the controlling step includes amplifying or attenuating a difference between the threshold and the motor signal to determine the carrier head pressure control signal.

20. The method of claim 18, wherein the motor signal is a carrier head control signal, a platen control signal, or a motor current signal.

21. The method of claim 18, wherein the controlling step includes smoothing the carrier head pressure control signal.

22. The method of claim 17, wherein the polishing surface includes a fixed abrasive polishing material.

23. The method of claim 17, wherein creating relative motion includes rotating the polishing surface.

24. The method of claim 17, wherein creating relative motion includes rotating the substrate.

* * * * *